US005365892A

United States Patent [19]

Kienle

[11] Patent Number: 5,365,892

[45] Date of Patent: Nov. 22, 1994

[54] ROTARY INTERNAL COMBUSTION ENGINE

[76] Inventor: Gerhard K. Kienle, Schönwalterstrasse 11, D-7000 Stuttgart 31, Germany

[21] Appl. No.: 126,741

[22] PCT Filed: Apr. 13, 1988

[86] PCT No.: PCT/EP88/00310

§ 371 Date: Dec. 15, 1989

§ 102(e) Date: Dec. 15, 1989

[87] PCT Pub. No.: WO88/08074

PCT Pub. Date: Oct. 20, 1988

Related U.S. Application Data

[63] Continuation of Ser. No. 29,309, Mar. 8, 1993, abandoned, which is a continuation of Ser. No. 951,333, Sep. 25, 1992, abandoned, which is a continuation of Ser. No. 439,395, Dec. 15, 1990, abandoned.

[30] Foreign Application Priority Data

Apr. 16, 1987 [DE] Germany ..... 3712992

[51] Int. Cl.[5] ..... F02B 57/00

[52] U.S. Cl. ..... 123/44 D; 91/491; 92/157

[58] Field of Search ..... 123/44 R, 44 D; 92/153, 92/157; 91/491

[56] References Cited

U.S. PATENT DOCUMENTS

| | | | |
|---|---|---|---|
| 719,359 | 1/1903 | McPherson | 123/44 R |
| 1,105,118 | 7/1914 | Weinberg | 123/44 D |
| 1,249,845 | 12/1917 | Soppitt | 123/44 D |
| 1,286,985 | 12/1918 | Freer | 123/44 D |
| 2,665,668 | 1/1954 | Ward | 123/44 C |
| 3,200,797 | 8/1965 | Dillenberg | 123/44 D |
| 3,431,894 | 3/1969 | Allred | 123/44 D |
| 3,499,424 | 3/1970 | Rich | 123/44 D |
| 3,581,718 | 6/1971 | Petty | 123/44 D |
| 3,730,152 | 5/1973 | Vincent et al. | 123/44 D |
| 4,256,061 | 3/1981 | Lappa | 123/44 D |

*Primary Examiner*—Richard A. Bertsch
*Assistant Examiner*—Charles G. Freay
*Attorney, Agent, or Firm*—Jones, Tullar & Cooper

[57] ABSTRACT

An internal combustion engine has at least one piston (15, 16) which moves back and forth in a cylindrical piston bore (13, 14) and drives a rotationally supported crankshaft (30) through a connection rod (24, 25). The piston bore (13, 14) is arranged in a rotary element (10) rotationally supported in a housing (1). The rotary element (10, 17) and crankshaft (30) are cinematically coupled through a gear (40, 41, 42, 43) so that they can rotate in opposite directions (60 or 61). The piston bore (13, 14) arranged in the rotary element (10) communicates with an opening (20, 21) in the outer surface of the rotary element (10, 17) which moves past an inlet opening (50) and an outlet opening (51) in the housing (1) during rotation of the rotary element (10).

4 Claims, 5 Drawing Sheets

ROTARY INTERNAL COMBUSTION ENGINE

CROSS REFERENCE TO RELATED APPLICATIONS

This application is a continuation of application Ser. No. 08/829,309, filed Mar. 8, 1993 and now abandoned, which is a continuation of application Ser. No. 07/951,333, filed Sep. 25, 1992 and now abandoned, which is a continuation of application Ser. No. 07/439,395, filed Dec. 15, 1990 and now abandoned.

BACKGROUND OF THE INVENTION

The present invention relates to an internal combustion engine, having at least one piston capable of reciprocating in a cylindrical piston bore and acting on a rotatably supported crankshaft via a connecting rod, a rotor containing the piston bore, the rotor being rotatably supported in a housing and coupled for motion to the crankshaft by a gear in such a way that the rotor and the crankshaft rotate in opposite directions, the piston bore disposed in the rotor communicates with an opening in the outer surface of the rotor that upon rotation of the rotor, moves past an inlet opening and an outlet opening of the housing.

An internal combustion engine of this type is known from U.S. Pat. No. 1,598,518. In this known engine, cooling takes place externally, on the one hand with the aid of a water chamber disposed in the vicinity of the spark plugs, and on the other hand with the aid of a fan wheel integrated with the rotor on one end face. This patent does not disclose what kind of lubrication is used for the movable parts.

It is also know as a main characteristic of a piston motor to have arc-formed piston elements in a rotor which rotates in a housing. The piston elements are inside of the rotor guided and movable like valves so that between them and the circumference of the rotor work chambers thereby arise. With levers the piston elements are supported at a fixed axis so that movement of the piston elements as a result of combustion leads to rotor rotation in the working chambers (see, DE-PS 31 50 654). The fuel/air mixture supply as well as the outlet of the exhaust gases will be directed with slides, which are arranged for each work chamber and will be controlled by a section of the rotor as a function of rotation. The disadvantage here is the relatively complicated form of the slide-control, which also exhibits seal problems. Furthermore, because of reasons of production and economy, the use of unusual lift-pistons as piston elements is disadvantageous. Further, it is disadvantageous to have a non-cylindrical work chamber because the cylindrical form of the combustion chamber is better suited for a symmetrical extension of the combustion process, and, for good effect, complete combustion of all combustible ingredients.

A combustion engine is also known from (DE-OS 25797), in which two running pistons running together with, at times, two working pistons are provided which move against each other while rotation of the running pistons lead by a wing portion situated at fixed pivots, is established eccentric to the rotor axis.

The wing portion is extraordinarily susceptible to breakage. Moreover, the mixture inlet and the exhaust gas outlet are not optimally formed. Further, there are combustion engines known from (DE-OS 2339957 and DE-OS 2339958, in which a double effective work piston is established in a rotor bore, whereby the rotor rotates in a housing. Thereby, transposition of the piston motion into rotation follows in such a way that an eye which is established inside of the work piston is forced eccentric to the axle. The construction of this engine is extraordinarily complicated, especially the form of the piston.

SUMMARY OF THE INVENTION

An object of the present invention is to provide an internal combustion engine of the type defined above in such a way, that with as simple a construction as possible, even at low rotations, high power and especially quiet operation is obtained. A simple construction means that any kind of valve control and/or slide control is unnecessary.

The advantages with regard to the quiet operation of the above defined internal combustion engines having an arrangement of pistons or piston elements inside a rotor is assured, without the complicate piston forms and/or controls, which were necessary until now.

According to the present invention, the first stated object is achieved in such a way that the piston bore is established in a rotor, which is rotatably situated in a housing, and that further the rotor and crankshaft are coupled together through a gear in such a way that they rotate in opposite directions and that the piston bore inside the rotor is connected to an opening in the external surface of the rotor, which moves past an inlet opening and an outlet opening in the housing during rotation of the rotor.

With this internal combustion engine, a whole cycle of a four-cycle-combustion process can be accomplished with one rotation of the rotor, that results in a high power output and quiet operation. Valves or slides are not necessary. The supply of the air/fuel mixture (in case of an Otto-engine) or air (in case of a Diesel-engine), respectively, and the removal of the exhaust gases happens in the most simple way through slits in the housing where the opening of the piston bores move past. This past motion happens at the right time, which means during the aspiration phase or the expulsion-phase, respectively.

A preferred exemplary embodiment is characterized in that two piston bores offset by 180° from one another are disposed in a rotor and that the connecting rods on the crankshaft engage two connecting rod gearings offset from one another by 180°. Two opposed and contrary motion pistons, enclosing an angle of 180° are provided which results in a smooth and quiet operation and a simple construction.

A variation of this exemplary embodiment is characterized in that the longitudinal axis of the two piston bores are disposed offset from one another in the direction of the crankshaft axis. According to another variation, a coaxial piston arrangement or cylinder arrangement respectively is provided which results in an even flatter and more-compact design, which leads to a reduction in weight and even quieter operation. This variation is characterized in that the longitudinal axis of the piston bores are in alignment with one another, and that the connecting rod bearings are disposed correspondingly symmetrically with respect to these longitudinal axes. A useful version of this second variation characterized in that at least one of the two connecting rods is embodied as substantially U-shaped and is pivotably connected to the other connecting rod via a pivotable intermediate member, and/or characterized in that the one connecting rod is U-shaped and the other connecting rod is a flat bar, and that on and between the two connecting rods, two parallel bar-like intermediate elements are pivotably disposed at both ends, rigidly engaging the crankshaft. A preferred construction of the rotor, crankshaft and gear is characterized in that the rotor has a cylindrical raceway, which is rotatably disposed on the housing, that openings are provided in the raceway and communicate radially inward with the piston bores, and that the cylinders disposed inside the raceway are reinforced with respect to one another and with respect to the raceway by ribs. The crankshaft is supported with one end rotatably in one of two plates, which form a cap and bottom of the housing, respectively, and with its other end, the crankshaft is supported in a disk, which is part of the rotor, the power takeoff shaft being firmly connected to the rotor. Alternatively, the crankshaft is rotatably supported at both ends in a plate, which plates form a cap and bottom, respectively, of the housing, and penetrates a disk, which is part of the rotor, with one end of the crankshaft being connected to the power takeoff shaft in a manner fixed against relative rotation. The gear has a gear ring on the rotor, two gear wheels supported on the housing and meshing with the gearing, and one gear wheel meshing with the latter two gear wheels and connected to the crankshaft. The two gear wheels each have two sets of teeth located one above the other, the sets having different diameters with the one set of teeth meshing with the gear ring on the rotor and the other set of teeth meshing with the gear wheel on the crankshaft.

It is another object of the present invention to provide an internal combustion engine of the type defined above, in which a combined oil delivery and removal system is provided that serves both to lubricate the various bearings and to provide cooling in the piston area.

According to the present invention the second stated object is achieved by an internal combustion engine of the above type in which the crankshaft is penetrated by an oil carrying system that is provided with outlet openings in the vicinity of the connecting rod bearings and/or the crankshaft bearings and/or the crankshaft elements, and in which oil outflow conduits lead away from the at least one piston bore, the conduits extending radially outward parallel to the piston bore in order to cool it, and the location in the piston bore at which the oil outflow conduits originate being disposed such that it is uncovered by the piston at top dead center.

By means of the oil conduit system according to the present invention and by utilizing the centrifugal force generated in the rotor, it is possible to provide bearing lubrication and oil cooling in the piston area simultaneously, with the aid of a single oil delivery and removal system.

To achieve a sufficient cooling of the cylinders and other parts of the internal engine oil outflow conduits are provided leading away from the piston bores, which for cooling extend partially radially outward parallel to the piston bore at which the oil drainage outflow conduits originate in the piston bore, which are uncovered by the piston at top dead center. The drainage outflow conduits lead along the cylinders and, if necessary, along the raceway for cooling of the cylinders. The outflow conduits are distributed over the inside circumference of the piston bores, and on the outside of the cylinder discharge into a groove on the outside of the circumference that communicates with an outflow bore in the disk of the rotor. Hereby, it is useful to provide lubrication oil for the separate bearings in connection with the oil cooling and to provide the lubrication oil for the oil by an oil conduit system which penetrates the crankshaft and is provided with outlet openings in the vicinity of the connecting rod bearings and/or of the crankshaft bearings and/or the crankshaft disks, and/or in that the outlet openings in the vicinity of the connecting rod bearings are embodied by axial grooves or channels on the outside surface of the crankshaft elements and/or of the connecting rods and/or of the intermediate elements. Thus, in an easy and advantageous way a single oil delivery and removal system is provided.

The valveless and/or slideless control of the aspiration phase and the expulsion phase can be provided by suitable disposition and embodiment of the inlet and outlet openings, for example, the inlet opening and/or the outlet opening may extend in the cylindrical wall of the housing over an angle of approximately 20°, over a range of 125° to 165°. Also, the inlet opening and the outlet opening may be disposed adjacent to one another along the cylindrical wall of the housing, or they may also overlap one another.

A fuel-saving mode of operation at partial load of the engine is provided by having the inlet opening and the outlet opening coverable or partially coverable by a slider arrangement.

BRIEF DESCRIPTION OF THE DRAWINGS

Exemplary embodiments of the invention and advantageous further features thereof are described in further detail below, referring to the accompanying drawings.

DESCRIPTION OF THE PREFERRED EMBODIMENTS

Figure 1:
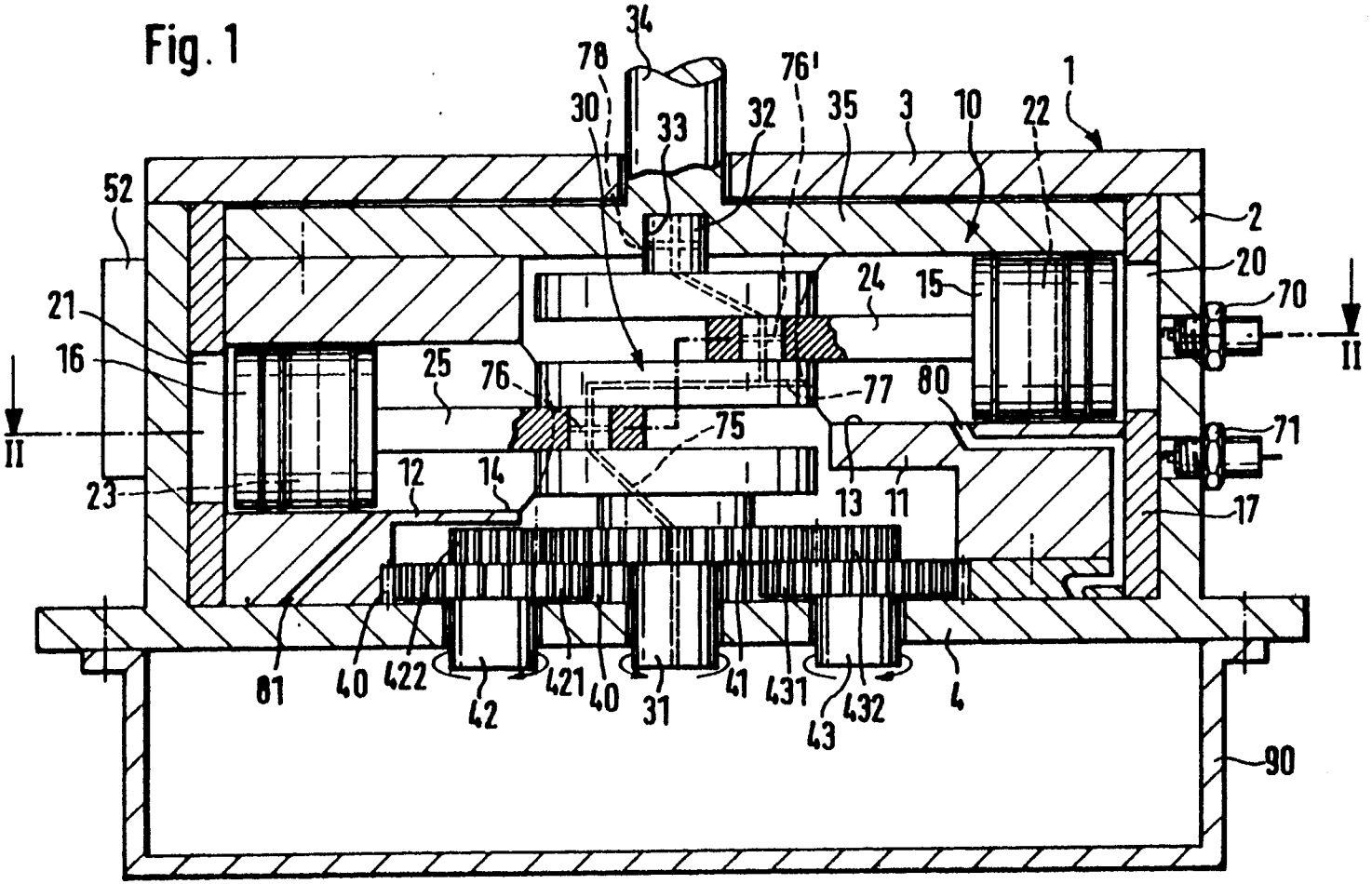
FIG. 1 is a section through an internal combustion engine of a first exemplary embodiment.
Figure 2:
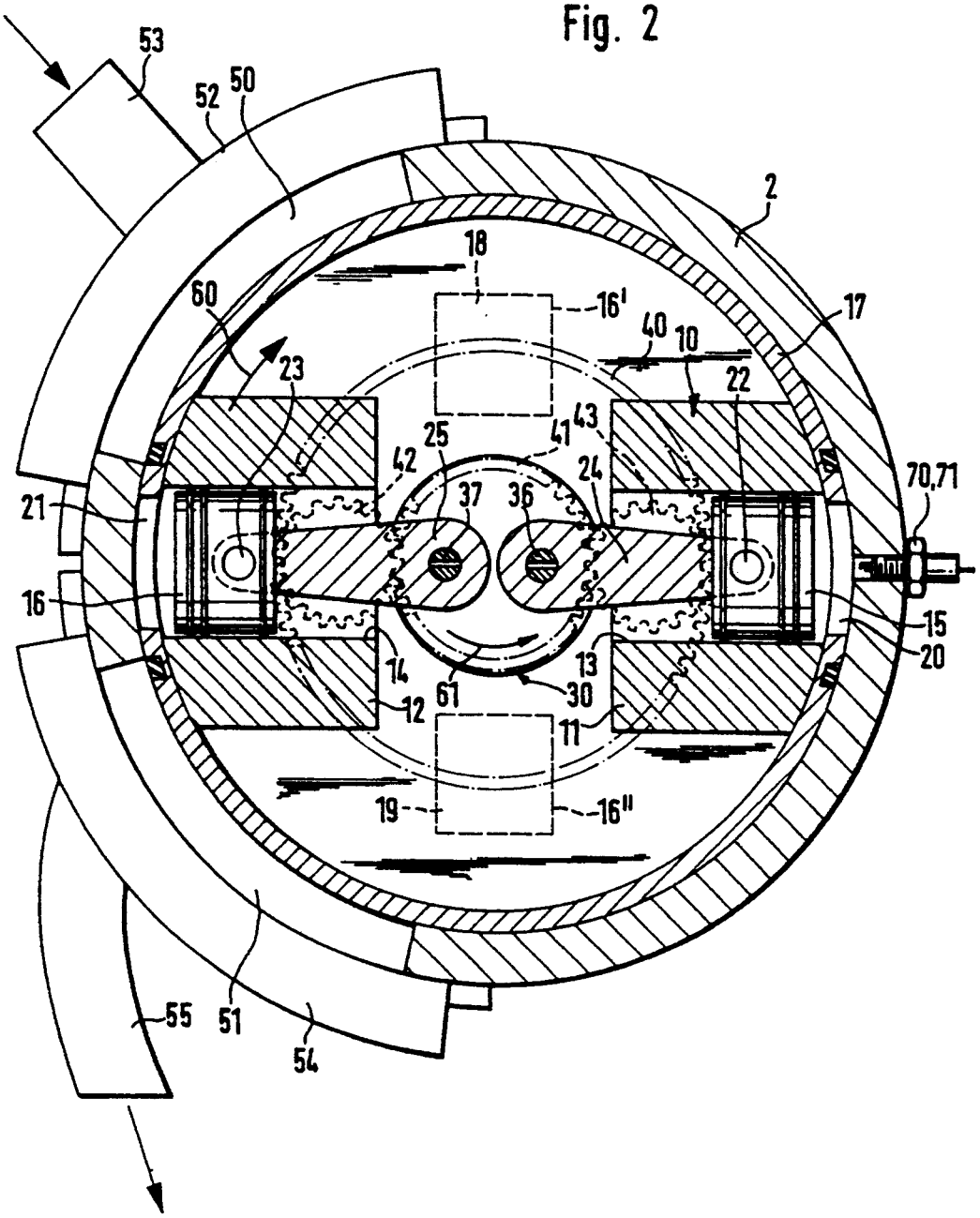
FIG. 2 is a further section through the first exemplary embodiment taken along the line II—II in FIG. 1.
Figure 2A:
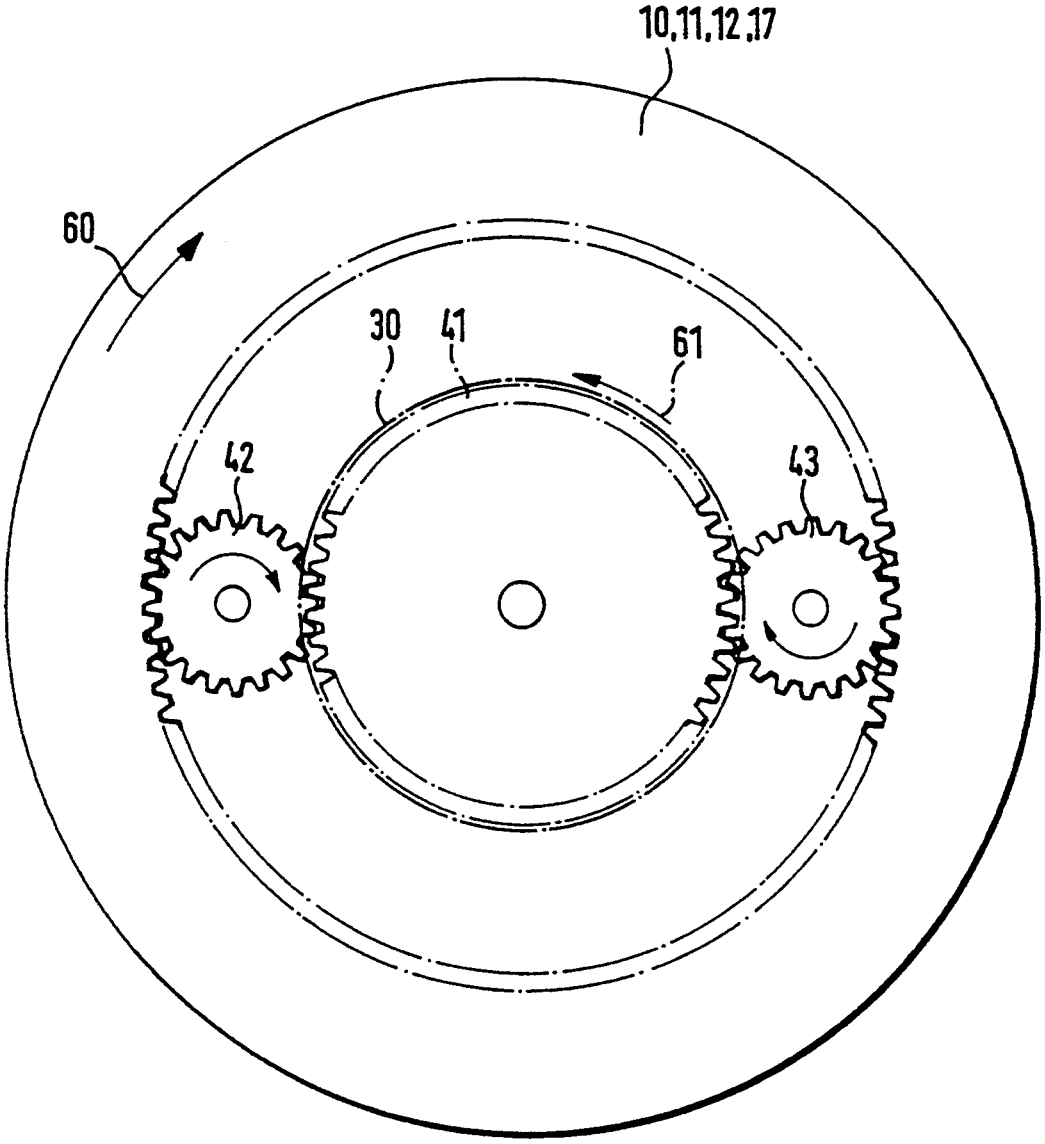
FIG. 2*a* is a schematic illustration of the coupling of the motion of the rotor to the motion of the crankshaft.

In the exemplary embodiment of the present invention shown in FIGS. 1, 2 and 2*a*, the housing 1 in this internal combustion engine is embodied by a cylindrical wall 2, an upper flat cover disk 3 and a likewise substantially round lower base plate 4. The housing 1 thus basically has the shape of a round disk, the height of which is equal to the height of the cylindrical wall 2. This housing is stationary. A rotor 10 rotates in the housing 1. This rotor includes two cylinders 11, 12, axially offset from one another, a disk 35 and a raceway 17.

The cylinders 11, 12 are provided with cylindrical piston bores 13, 14, respectively, in which pistons 15, 16 are reciprocatably disposed. The cylinders 11, 12, in the form of inserts, are firmly joined to the inner raceway 17. Ribs 18, 19 (not shown in FIG. 1, for simplicity) serve to lend the entire rotor 10 sufficient rigidity as a unit. The raceway 17 is provided with openings 20, 21 at the locations where the piston bores 13, 14 border it. Connecting rods 24, 25 are pivotably attached to the pistons 15, 16 by means of piston bolts 22, 23, and the connecting rods are supported in connecting rod bearings 36, 37, disposed offset from one another by 180°, on a crankshaft 30, so that the pistons execute a simultaneously contrary motion. The crankshaft 30 is supported with its lower bearing journal 31 in the base plate 4. The upper bearing journal 32 of the crankshaft 30 is rotatably supported in a blind bore 33 that is provided in the disk 35. The disk 35 is a fixed component of the rotor 10 and rotates with it. Also firmly joined to the disk 35 is the power takeoff shaft 34, which is supported in the upper cover disk 3 of the housing 1. Accordingly, the crankshaft 30 and the rotor 10 are rotatable counter to one another. The crankshaft 30 is also rotatable with respect to the housing 1.

A coupling of the rotational motion of the rotor 10 (including the cylinders 11, 12, the raceway 17, ribs 18, 19, disk 35, and power takeoff shaft 34) with the rotational motion of the crankshaft 30 is effected via a planetary gear. This gear is embodied by an inner gear ring 40 (see FIG. 1) on the underside (in FIG. 1) of the rotor 10, a gear wheel 41 on the crankshaft 30, and two further gear wheels 42 and 43. The gear wheels 42 and 43 are supported in the base plate 4 of the housing 1. They are of a "two-staged" embodiment; that is, they have first sets of teeth 421 and 431, which mesh with the inner gear ring 40 on the rotor 10. They also have second sets of teeth 422 and 432 of somewhat smaller diameter, which mesh with the gear wheel 41 that is a component of or is firmly disposed on the crankshaft 30. In this way, it is assured that a rotation of the rotor 10 compelled by the reciprocation of the pistons always leads to a defined rotation of the rotor 10 in the housing 1; the rotational directions of the rotor 10 and the crankshaft 30 are opposed to one another. This is schematically shown in FIG. 2*a*.

As can be seen from FIG. 2, the cylindrical wall 2 is provided along its circumference with an inlet slit 50 and an outlet slit 51. The inlet slit 50 extends over an angle of approximately 70° of an arc. It is covered by an inlet chamber 52, the inlet opening 53 of which communicates with a carburetor, for instance (not shown). The outlet slit 51 likewise extends over approximately 70°. It communicates with an outlet chamber 54 that via an outlet opening 55 communicates with an exhaust pipe, for instance (not shown). When the openings 20 and 21 in the raceway 15 move past the slits 50, 51 with the rotor 10 in rotation, then correspondingly the regions of the piston bores 13, 14 in the cylinders 11, 12 located radially outward of the pistons 15, 16 also move past the slits 50, 51 and communicate with them during the passage past them.

The relative disposition of the slits 50, 51, to one another is as follows: With a circular cross section of the rotor 10, of which the inner raceway 17 is a component, the inlet slit 50 and outlet slit 51 are located next to one another on the same semicircle, in such a way that the inlet slit 50 is located in the range between 270° and 360°, and the outlet slit 51 is located in the range between 180° and 270°.

For an explanation of the course of the motion taken by the two-cylinder, four-stroke engine shown as an example, the outset position of the piston 16 is as shown in FIG. 2. If the rotor 10 rotates clockwise with respect to that position, as indicated by the arrow 60, then the opening 21 sweeps past the inlet slit 50. At the same time, the crankshaft 30 rotates counterclockwise, as indicated by the arrow 61. This moves the piston 16 (as well as the piston 15) radially inward. Through the inlet slit 50, the piston 16 aspirates a fuel/air mixture (or fresh air in the case of a Diesel engine). It has attained bottom dead center when the rotor 10 has rotated onward by 90° from the position shown in FIG. 2. The piston 16 is then located in the position 16' shown in dashed lines. At that time, the aspiration phase is ended. The opening 21 has left the region in which it coincided completely or partially with the inlet slit 50. The compression phase now begins, in which the piston 16 is forced radially outward as a consequence of the onward motion of the crankshaft 30 and rotor 10 in the directions indicated. Top dead center is attained when the piston 16 is in the position offset by 180° from the outset position (FIG. 2). That is the position in which the piston 15 is shown in FIG. 2. Here the ignition takes place, by means of a spark plug 71. The expansion phase then begins. The piston begins to move radially inward again. In this process, the rotor 10 rotates onward in the direction of the arrow 60, until the second bottom dead center is attained, at which the piston 16 has rotated by 270° with respect to the outset position shown in FIG. 2. The piston is then in the position 16'' drawn in dashed lines. As the rotation continues, the expulsion of the exhaust gases begins, by the radially outward motion of the piston 16 once again, and at the same time the opening 21 sweeps past the outlet slit 50, so that it expends the exhaust gas. Accordingly, a complete four-stroke cycle is attained with only a single rotation of the rotor 10. This is the consequence of the fact, among other factors, that the rotor 10 and crankshaft 30 rotate counter to one another, so that the piston 16 executes two strokes in only a single rotation of the rotor 10 or only a single rotation of the crankshaft 30, and during the first stroke accomplishes the phases of aspiration and compression and in the second stroke accomplishes the phases of expansion and expulsion.

The cycle for the piston 15 evolves in the same way as described above for the piston 16, except that it is offset by a one-half rotation of the rotor 10. In other words, when the piston 16 is aspirating, the piston 15 is in the expansion phase; when the piston 16 is compressing, the piston 15 expels the exhaust gases. When the piston 16 expands, the piston 15 is aspirating; and when the piston 16 expels the exhaust gases, the piston 15 is compressing. The ignition for this is effected by means of a spark plug 70, which is disposed above the spark plug 71 offset by the amount of offset of the cylinder axes. The slits 50, 51 are associated with both pistons 15, 16. It is also possible to use only a single spark plug, which to this end is disposed in a middle plane, that is, facing both combustion chambers.

Lubrication is effected in such a say that oil available under pressure is delivered by an oil pump (not shown) to a bore 75 (drawn in dashed lines) in the crankshaft 30. The bore 75 communicates with transverse bores 76, 76', 78 and 77, through which on the one hand the connecting rod bearings 36, 37 and the bearing 32, 33 are lubricated, and on the other hand, oil can also freely flow into the interior of the housing 1 (bore 77), where it is spun radially against the underside of the pistons 15, 16, and hence against the cylinder/piston bores 13, 14 as well, by centrifugal force. The removal of the oil is effected through oil conduits 80, 81. The transporting of the oil is also effected by centrifugal force, because the oil conduits 80, 81 are located in the rotating rotor 10.

The oil conduits 80, 81 open into the cylinder/piston bores 13, 14 at locations that at top dead center of the pistons 15, 16 are just below the underside of the pistons 15, 16. From there, the oil flows back into the oil pan 90. The oil conduit 80 is extended radially as far as the raceway 17, spaced relatively slightly apart from the wall of the cylinder/piston bore 13, so that a cooling of the wall of the cylinder 11 can be effected in this way. The oil conduit 80 then extends parallel to the axis of rotation along the raceway 17, so that the raceway is cooled as well. The oil conduit 81 can be embodied in the same way.

Since a complete four-stroke cycle is already accomplished by each piston in one rotation of the rotor 10, then the engine can already bring high power to bear at low rpm, and runs extraordinarily quietly by comparison with an engine having a stationary cylinder. The smoothness of operation is still further reinforced by the fact that the crankshaft and rotor rotate counter to one another, so that with suitable dimensioning of their mass, the vibration they cause is partly compensated for and damped. Moreover, because the rotor moves past the inlet and outlet slits 50, 51, an engine without valves is created, in other words, one which is of extremely simple and hence inexpensive design. The sealing problems can be solved very easily because all the seals that are provided on the outside of the raceway 17 and seal it off from the cylindrical wall 2 of the housing 1 are forced into the sealing position by centrifugal force as the rotor 10 rotates. In the Diesel engine version, a further seal or sealing strip is then additionally provided.

The cooling can also be accomplished relatively simply with suitable oil throughput, because upon emerging from the oil conduits in the crankshaft, centrifugal force assures that the oil will reach all the locations to be lubricated or cooled. The engine moreover assures an extremely compact structure and hence a comparatively low weight.

Figure 3:
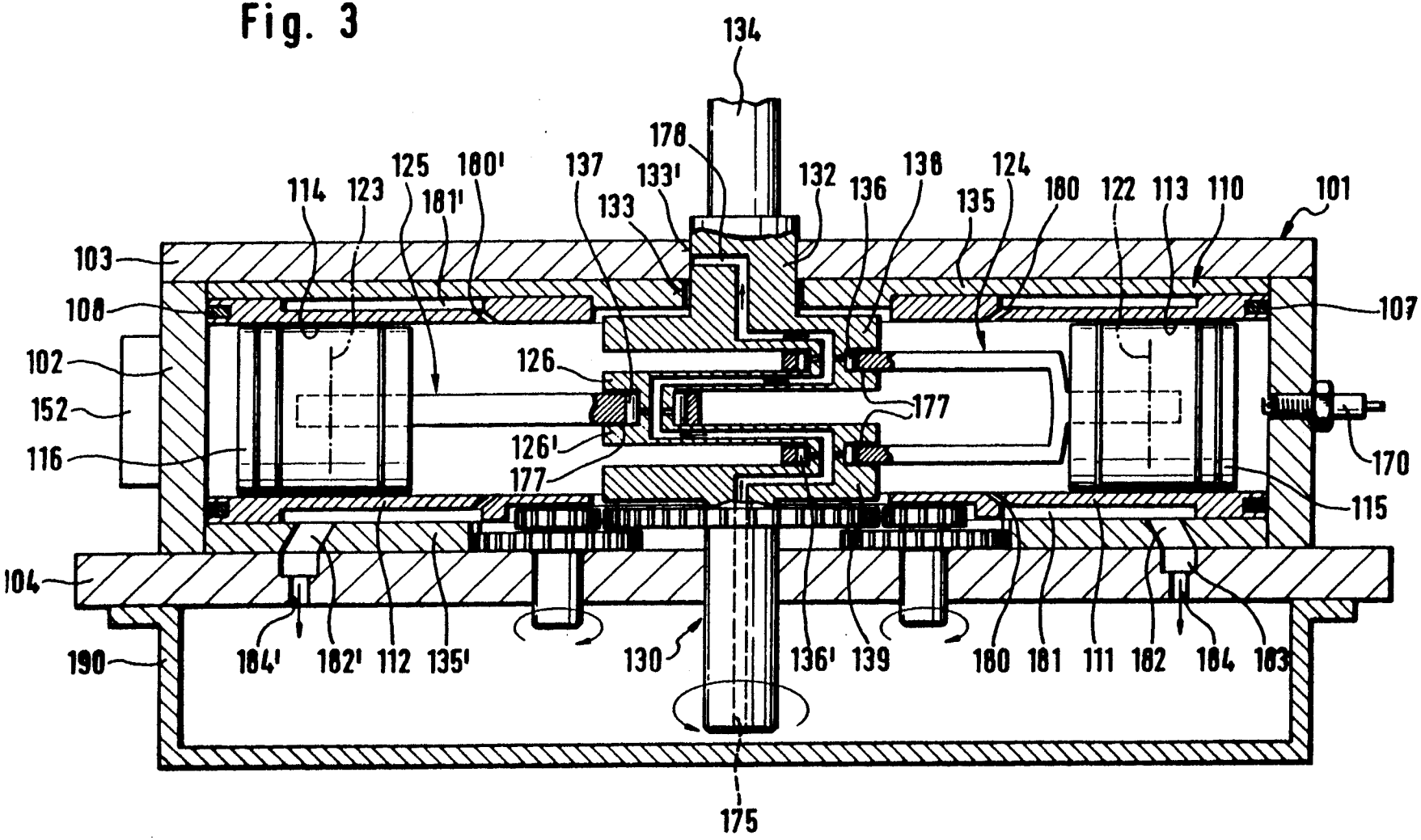
FIG. 3 is a section similar to that of FIG. 1, but for an internal combination engine of a second exemplary embodiment.

In the internal combustion engine shown in a second exemplary embodiment in FIG. 3, the housing 101 is once again embodied by a cylindrical wall 102, an upper flat cover disk 103 and likewise substantially round lower base plate 104. A rotor 110 rotates in the stationary housing 101. This rotor 110 again includes two cylinders 111 and 112, but in contrast to the first exemplary embodiment they are disposed coaxially; that is, their longitudinal axes are in alignment. The two cylinders 111 and 112 are embodied as inserts and are retained between an upper and a lower disk 135, 135', which are components of the rotor 110. Once again, the cylinders 111 and 112 are provided with cylindrical piston bores 113 or 114, in which respective pistons 115 and 116 are likewise disposed such that they reciprocate counter to one another. The cylinders 111, 112 are firmly joined to the disks 135, 135' and have annular sealing strips 107, 108 sealing them off from the wall 102. It will be understood that in this embodiment as well, a raceway may be provided in front of the cylinder, in which case the raceway then includes the sealing strips. Connecting rods 124, 125 are pivotably connected to the pistons 115, 116 by means of piston bolts 122, 123, which are merely suggested in the drawing, and the longitudinal axes of the connecting rods are in alignment at top dead center of the pistons.

In this exemplary embodiment, unlike the first exemplary embodiment of FIG. 1, the two connecting rods 124 and 125 are embodied differently from one another. The connecting rod 124 is substantially U-shaped, and on the crossbar of the U, connecting the two side legs, it has an extension lengthwise in the middle, which is pivotably connected to the piston 115 via the piston bolt 122. The two free ends of the parallel, longitudinally extending legs of the U-shaped connecting rod 124 are supported in coaxially disposed connecting rod bearings 136, 136', which are provided opposite one another in two lateral crank disks 138, 139 of a crankshaft 130, at a location on its circumference. Two parallel bar-like intermediate members 126, 126' are also retained in such a way on these connecting rod bearings 136 and 136', on the insides of the U-shaped connecting rod 124 remote from the crank disks 138, 139, that they are pivotable with respect to the connecting rod 124, but are connected in a manner fixed against relative rotation to the two crank disks 138, 139. Their ends, bent at an angle for this purpose, are pivotably connected to the other bar-like connecting rod 125 by means of a bearing 137. The intermediate members 126, 126' have a length equivalent to the diameter of the crank disk 138, 139. The connecting rod 125 is disposed between the two intermediate members 126, 126'. In this way, the pivot point of the connecting rod 125, via the piston bolt 123 in the piston 116, is coaxial with the pivot point of the U-shaped connecting rod 124 via the piston bolt 122 in the piston 115. It will be understood that the spacing on the inside between the connecting rod bearings 136, 136' and the transverse leg of the U-shaped connecting rod 124 is somewhat greater than the length of the intermediate members 126, 126', so that in the rotational motion of the crankshaft 130, the intermediate members 126, 126' can move through the U-shaped connecting rod 124 or, in other words, between its legs.

The crankshaft 130, unlike the crankshaft of the first exemplary embodiment, is connected in a manner fixed against relative rotation with a power takeoff shaft 134, with the upper bearing journal 132 of the crankshaft, which journal penetrates bores 133, 133' in the disks 135 and 103 and is supported in these disks. Once again, the crankshaft 130 and rotor 110 are rotatable counter to one another, and the crankshaft 130 is rotatable counter to the housing 101.

The coupling of the rotational motion of the rotor 110 with that of the crankshaft 130 is effected via a planetary gear, which is embodied and functions in the same manner as the planetary gear shown in FIGS. 1, 2 and 2*a*. This planetary gear is therefore not further described here. In FIG. 3, accordingly, the same reference numerals are used as in FIG. 1, but preceded with a 1.

The lubrication and cooling of the internal combustion engine according to the second exemplary embodiment of FIG. 3 is effected in a structurally similar manner to the first exemplary embodiment. An oil pump, not shown here, forces oil into an axial bore 175 and the crankshaft 130. The bore 175 is continued in the crank disks 138, 139, the bearings 136, 136', 137 and the intermediate members 126, 126', and ends in a transverse bore 178, discharging radially outward in the bearing bore 133'. The exit of the bore 175 to the interior of the cylinder/piston bore 113, 114 is accomplished in such a way that in the vicinity of the bearings 136, 136', 137, grooves or channels 177, only suggested in the drawing here, are provided in that mutually opposed surfaces of connecting rods 124, 125 or intermediate members 126, 126' or crank disks 138, 139.

Once again, the oil emerging from this bore system 175, 177 is spun by centrifugal force onto the underside of the pistons 115, 116 and hence onto the inner faces of the cylinder/piston bore 113, 114 as well. The oil is drained out via oil conduits 180, 180', provided preferably at uniform intervals along the inside circumference of the piston bore 113, 114; these channels discharge into a wide circumferential groove 181, 181' provided on the outside circumference of the cylinder 111, 112. The grooves 181, 181' extend along a substantial portion of the length of the cylinder 111, 112, so that they are suitable as a conduit for cooling the region of the cylinder. A discharge conduit 182, 182' is provided in the disk 135' on an end region remote from the oil conduits 180, 180' of the grooves 181, 181', and a narrow inner annular groove 183 is disposed in the base plate 104 opposite the discharge conduit and itself discharges via two bores 184, 184', for example into the oil pan 190. In this exemplary embodiment, the inlet and outlet openings can be provided with the associated chambers in a manner corresponding to that of the first exemplary embodiment. This is correspondingly true for the spark plug 170, which because of the coaxial disposition of the cylinders or pistons and hence of the combustion chamber is disposed in the middle of the housing at a location on the outer circumference of the housing 101.

Figure 4:
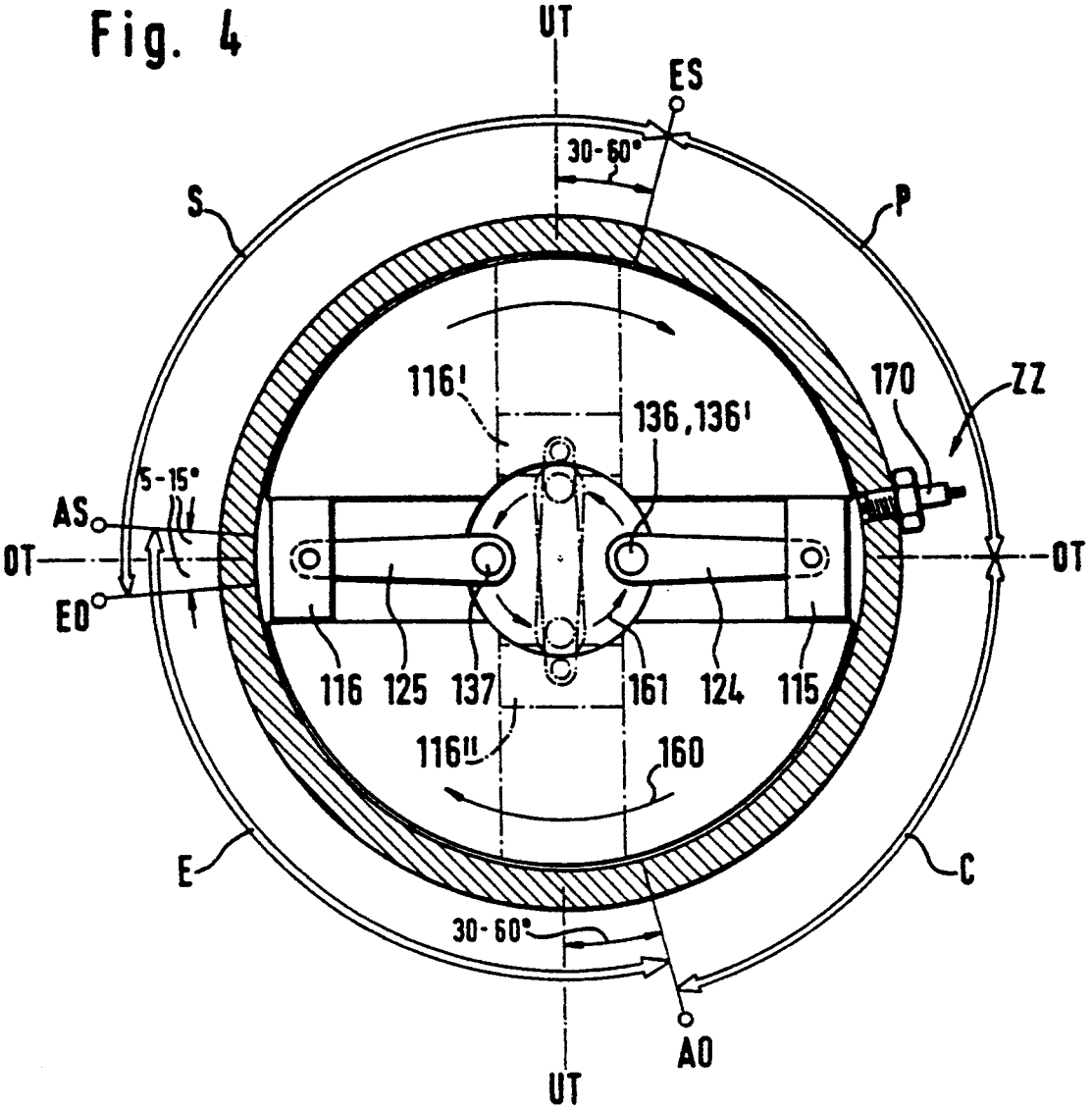
FIG. 4 is an illustration corresponding to FIG. 2, but shown schematically, for a variant of both exemplary embodiments.

However, in both the first and second exemplary embodiments of the present invention, it is also possible to have the various phases of the four-stroke motion proceed as schematically shown in FIG. 4. In this drawing, the abbreviations are as follows: OT=top dead center; AS=outlet closes; UT=bottom dead center; ES=inlet closes; ZZ=instant of ignition; AO=outlet opens; E=inlet opens. During the period S, aspiration takes place; during the period P, compression takes place; during the period C, the mixture is combusted; and during the period E, the combusted gases are blown out. As can be learned from this schematic drawing, beginning at the top dead center position of the two pistons shown in solid lines, with the rotation of the crankshaft 130 counter to the arrow 161 representing the clockwise direction, a rotation of the rotor 110 takes place in the opposite direction, namely, in the direction of the arrow 160. Because the inlet slit 150 and the outlet slit 151 taper, overlap one another, the aspiration of fresh air already occurs at the same time as the remaining expulsion of the combusted mixture by the piston 116 out of the combustion chamber. The overlap of the inlet and outlet slit 150, 151 is preferably provided over an angular range between 5° and 15°. This overlap is advantageous in that a negative pressure is already created upon the expulsion of the remaining combusted mixture, and this negative pressure is advantageous for the aspiration that then simultaneously begins. The aspiration phase extends to beyond bottom dead center UT (the piston position 116' shown in dashed lines), beyond an angular range between 30° and 60°, so that the inertia is taken into account. Following that, at time ES, the compression takes place, with the spark plug 170 disposed just before top dead center OT (the position of the piston 115 shown in the drawings). the compressed mixture ignites. Thus, from OT, the combustion of the mixture or in other words the expansion operation can be performed, which continues into an angular range of approximately 30° to 60° before the bottom dead center position UT (piston position 116'' in dashed lines). At that instant, the outlet slit 151 is opened or, in other words, the cylinder chamber comes to communicate with it so that the expulsion of the combusted mixture begins, at the end of which this phase of expulsion or blowing out of the mixture again overlaps with the aspiration operation. It will be understood that the process is effected in a manner that is offset by 180° in time and in position for the other piston 115 as well. This means that the outlet opening 151 extends in an angular range from between 120° and 150° to between 275° and 285°, and the inlet opening 150 extends in an angular range from between 255° to 265° to between 390° and 420°.

Figure 5:
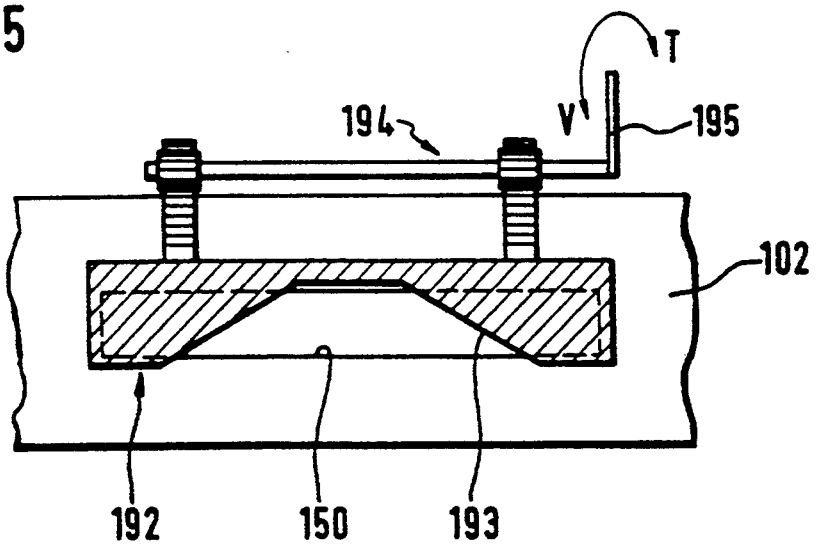
FIG. 5 is a schematic developed side view of a control slide for partial-load operation.

FIG. 5 is a developed side view showing a region of the cylindrical wall 102 containing the inlet slit 150. In this embodiment, which can correspondingly be used in both the exemplary embodiment of FIG. 1 and the variant of FIG. 3, a slide 192 is provided for the inlet slit 150 an, in a manner not shown but in the same way, for the outlet slit as well; the slide serves to partly cover the inlet slit 150 in partial-load operation of the engine. To this end, the slide 192 is provided with a symmetrical recess 193 of a defined curved shape and a triggering mechanism 194, the lever 195 of which is drivably movable between the positions V (full load) and T (partial load), with the inlet slit 150 being substantially completely opened at full load. The slide 192 is disposed on the circumference and therefore is curved in accordance with the wall 102 and is movable from one side along the wall 102. It will be understood that instead, two opposed slides that can be moved toward one another may be provided.

Although arrangements having two opposed piston/cylinder units have been described for the above exemplary embodiments, it will be understood that arrangements having more than two such units, for example, four, six or eight piston/cylinder units, are also possible, with every pair of units being correspondingly angularly offset and offset with respect to the housing in the axial direction by less than the outside diameter of the cylinder.

I claim:

1. An internal combustion engine, comprising:

a housing having an inlet opening and an outlet opening;

a rotor rotatably supported in said housing, said rotor having an outside surface and at least two openings extending through said outside surface, each associated with a piston bore;

means in said rotor defining at least one pair of cylindrical piston bores, offset by 180° from one another;

a pair of pistons;

a crankshaft including a bearing journal at one end thereof;

a connecting rod associated with each piston for connecting its associated piston to the crankshaft for reciprocal displacement of the piston in a respective cylindrical piston bore, at least one of the connecting rods being embodied as substantially U-shaped;

at least one connecting rod bearing for mounting each connecting rod to the crankshaft for pivotable movement relative thereto; and gear means for coupling said rotor for motion to said crankshaft, such that said rotor rotates in a direction opposite to that of said crankshaft, wherein:

the crankshaft includes lubricating bore means extending along its length for lubricating the bearing journal and each connecting rod bearing;

each piston bore communicates with a respective one of said openings in said rotor;

each opening in said rotor moves past the inlet opening and the outlet opening in said housing during rotation of said rotor; and the inlet opening of said housing extends over an angle of between approximately 255° to 265° to approximately 390° to 420°.

2. The internal combustion engine as defined in claim 1, further comprising:

an intermediate member, wherein:

the other of said connecting rods comprises a flat bar; and the intermediate member includes two parallel bar-like intermediate elements pivotably mounting one end of said flat bar.

3. The internal combustion engine as defined in claim 1, wherein the outlet opening of said housing extends over an angle in the range of between approximately 120° to 150° to approximately 275° to 285°.

4. The internal combustion engine as defined in claim 1, further comprising:

a slider arrangement, and wherein:

the inlet opening and the outlet opening of said housing are partially coverable by said slider arrangement.

* * * * *